US005993029A

United States Patent [19]

Chambers

[11] Patent Number: 5,993,029

[45] Date of Patent: Nov. 30, 1999

[54] LIGHTING FIXTURE GLOBE ATTACHMENT RING

[76] Inventor: Charles F. Chambers, 7542 Dexter Grove, Cordova, Tenn. 38018

[21] Appl. No.: 08/834,892

[22] Filed: Apr. 7, 1997

[51] Int. Cl.[6] ..... F21S 1/10; F21V 17/00

[52] U.S. Cl. ..... 362/363; 362/454; 362/457; 362/433

[58] Field of Search ..... 362/363, 362, 362/311, 453, 454, 455, 457, 433

[56] References Cited

U.S. PATENT DOCUMENTS

| | | | |
|---|---|---|---|
| 1,049,533 | 6/1913 | Risinger | 362/363 |
| 1,538,830 | 5/1925 | Lasky . | |
| 1,606,819 | 11/1926 | Townsend . | |
| 1,677,164 | 7/1928 | Arras . | |
| 1,692,029 | 11/1928 | Epstein et al. . | |
| 2,137,026 | 11/1938 | Phillips | 362/363 |
| 2,391,711 | 12/1945 | Kazanjian . | |

*Primary Examiner*—Stephen Husar
*Assistant Examiner*—Marshall Honyman
*Attorney, Agent, or Firm*—Terrance L. Siemens

[57] ABSTRACT

An attachment ring for clamping a globe having a flanged neck to a lighting fixture. The attachment ring comprises an encircling member which is configured as a "C" in an open condition. The encircling member is L-shaped in cross section, the bottom of the "L" providing a ledge on which the flange of the flanged neck of the globe will come to rest. An actuator constricts the C-shaped encircling member until it is closed, thereby attaining configuration of an "O" in a closed condition. When moving to the closed condition, the encircling member frictionally engages a tubular member of the lighting fixture from the outside of the lighting fixture. Simultaneously, the ledge moves under the flange of the globe, so that the globe is constrained against falling downwardly. The actuator is operated by a manual lever, and includes a locking feature maintaining engagement of the globe.

7 Claims, 2 Drawing Sheets

LIGHTING FIXTURE GLOBE ATTACHMENT RING

BACKGROUND OF THE INVENTION

1. Field of the Invention

The present invention relates to apparatus for attaching a depending spherical lens or globe to an associated lighting fixture. More specifically, the invention comprises a connector engaging both the globe and that portion of the lighting fixture intended to receive the globe. The connector comprises a constrictable ring which replaces the screws traditionally employed to secure the globe in place on the fixture.

2. Deascription of the Prior Art

Cylindrical, globular, and other lenses depending from lighting fixtures are typically secured in place by screws. These screws are arranged to project radially inwardly towards the longitudinal center of the lighting fixture. When threaded in a predetermined distance, they engage an outwardly turned flange formed in the neck of the cylindrical, globular, or other lens. For brevity, such lenses will be referred to as globes hereinafter. After engagement by the screws, the globe is prevented by interference between the screws and the flange of the neck of the globe from escaping engagement with the lighting fixture and falling down.

These screws are notoriously awkward to insert and tighten, as the task is best performed while holding the globe upright in place while attempting to grasp and tighten a succession of screws. Screws are also small parts susceptible to loss. They may be difficult to start, or initially engage a threaded hole.

The prior art has suggested various arrangements of encircling clamps and bands for replacing these screws. Clamps and bands generally either include or act on a member which constricts, in the sense of moving radially inwardly towards a vertical axis centered with respect to the lighting fixture where a lamp or light bulb is located. The member which has moved by constricting moves to a location interfering with downward motion of the globe. A globe is usually provided with a neck bearing outwardly turned flange for engaging screws or members replacing screws.

An example is seen in U.S. Pat. No. 1,677,164, issued to George Arras on Jul. 17, 1928. The device of Arras comprises an encircling band having two inner bands disposed inside the circumference of the encircling band. The inner bands interfere with downward motion of a globe retained thereby. The interfering members of the device of Arras are not radially symmetrical, as is an interfering member in the present invention. Also, Arras closes his clamp with a screw, which requires a tool. By contrast, the present invention utilizes a manual pull latch featuring an overcenter arrangement for opposing release of the globe.

A shade holder shown in U.S. Pat. No. 1,538,830, issued to Andrew Lasky on May 19, 1925, features a similar member disposed inside the circumference of the encircling band. Lasky's member comprises a coil spring, which complements an inwardly directed fixed flange. A globe is placed against the spring and maneuvered into appropriate engagement with the flange and the spring. By contrast, the present invention has a radially adjustable flange which constricts about the flange of the globe. No complicated maneuvering is required in the present invention. Rather than constantly exerting inward pressure, as results from the coil spring of Lasky, the present invention has a manual control for spreading the flange during insertion and removal of the globe.

An attachment device seen in U.S. Pat. No. 1,692,029, issued to James Barrett Epstein et al. on Nov. 20, 1928, engages a globe at three points of support symmetrically spaced about the inner perimeter of a circumferential band. Two of the three points comprise permanently fixed fingers which project inwardly. The third point is a member which is inwardly and outwardly adjustable. This third member is withdrawn when installing and removing the globe. The globe is then maneuvered past the fixed fingers. This construction requires tilting the globe when maneuvering. If not properly positioned during maneuvering when installing the globe, the globe could fail to be seated on both fixed fingers prior to moving the adjustable member into the supporting position. By contrast, the present invention has a supporting member extending entirely around the inner perimeter of its circumferential band. The globe is moved merely upwardly into position. No maneuvering and possible ineffective seating of a globe result.

U.S. Pat. No. 1,049,533, issued to Frank V. Risinger on Jan. 7, 1913, is generally similar in concept to the device of Epstein et al. Risinger provides two screws and one pivotally mounted lever to provide three points of support for a globe. By contrast, the present invention has a supporting member extending entirely around the inner perimeter of its circumferential band. The globe is moved merely upwardly into position. No maneuvering and possible ineffective seating of a globe result.

U.S. Pat. No. 2,391,711, issued to Souren R. Kazanjian on Dec. 25, 1945, shows a retainer for a lamp shade which employs plural circular members, one of which extends well over three hundred sixty degrees around the neck of the globe, preferably almost seven hundred twenty degrees. Constriction is accomplished by a screw anchored in a swivel joint. By contrast, the present invention has only one circular member which does not extend over three hundred sixty degrees as it encircles the neck of the globe. Constriction in the present invention is accomplished by a manual lever.

None of the above inventions and patents, taken either singly or in combination, is seen to describe the instant invention as claimed.

SUMMARY OF THE INVENTION

The present invention provides an uncomplicated globe attaching ring. The novel ring has essentially, a single, unified member encircling the neck of the globe, and an external latch or lock for maintaining the encircling member in a closed condition and for releasing the encircling member to assume an open condition. The encircling member comprises a split or open ring which can be moved between the open or spread condition, in which it has a configuration similar to that of a "C", and a closed condition, in which the ends meet, or nearly meet, to form a closed figure "O".

The lock has a manual lever and motion translation members for causing arcuate or rotating motion of the lever to effect constriction and relaxation of the encircling member. The lock includes a resilient member exerting a pulling force urging the encircling member to close when the lever is moved into the closed condition. In the open condition, the resilient member is relaxed, so that the encircling member can be opened or spread to slip over the flanged neck of the globe.

The encircling member is characterized by uniform or radially symmetrical construction. It incorporates a ledge, or an inwardly turned flange, which will come to underlie the flange formed in the neck of the globe in the closed condition. The flange will oppose downward movement of the globe by interfering with the ledge.

The encircling member simultaneously engages the connection tube of the lighting fixture. This member is tubular, so as to surround the flanged neck of the globe. The tube conventionally bears threaded holes for receiving screws. These screws are eliminated by the present invention. The tube is exploited to attach the novel attachment ring to the lighting fixture. The single encircling member of the novel attachment ring is configured to encircle and grip the connection tube of the lighting fixture simultaneously as it engages the globe. Engagement of the connection tube may be by friction, rather than by interference or penetration.

Several advantages accrue from this arrangement. One is that since the interfering retaining member of the attachment ring is generally radially symmetrical, the globe need not be maneuvered to engage some members. Rather, it need merely be pushed upwardly and held in a selected position while the lever is turned. Another advantage is that since supporting contact is made all along the circumference of the flanged neck, the globe will resist any tendency to become cocked, or inclined from the vertical.

No tools, such as screwdrivers, need be provided to operate the lock. The installer uses one hand to support the globe and the other hand to hold the novel attachment ring and move the handle of the lock. The handle of the lock is mounted to the novel attachment ring as to accommodate minor maneuvering of the attachment ring. Therefore, the novel device is easily installed with two hands.

Accordingly, it is a principal object of the invention to provide a clamp which retains a globe to a lighting fixture without using screws.

It is another object of the invention that the clamp act by constriction along a horizontal plane.

It is a further object of the invention to provide a member engaging the flanged neck of the globe along substantially the entire circumference of the flanged neck.

Still another object of the invention is to provide a manual lever for moving the encircling member between an open condition and a closed condition.

An additional object of the invention is to contact and engage both the lighting fixture and the globe simultaneously.

It is again an object of the invention to exert a resilient force urging the encircling member into the closed condition.

Yet another object of the invention is to provide a lock for securing the novel attachment ring in the closed condition.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
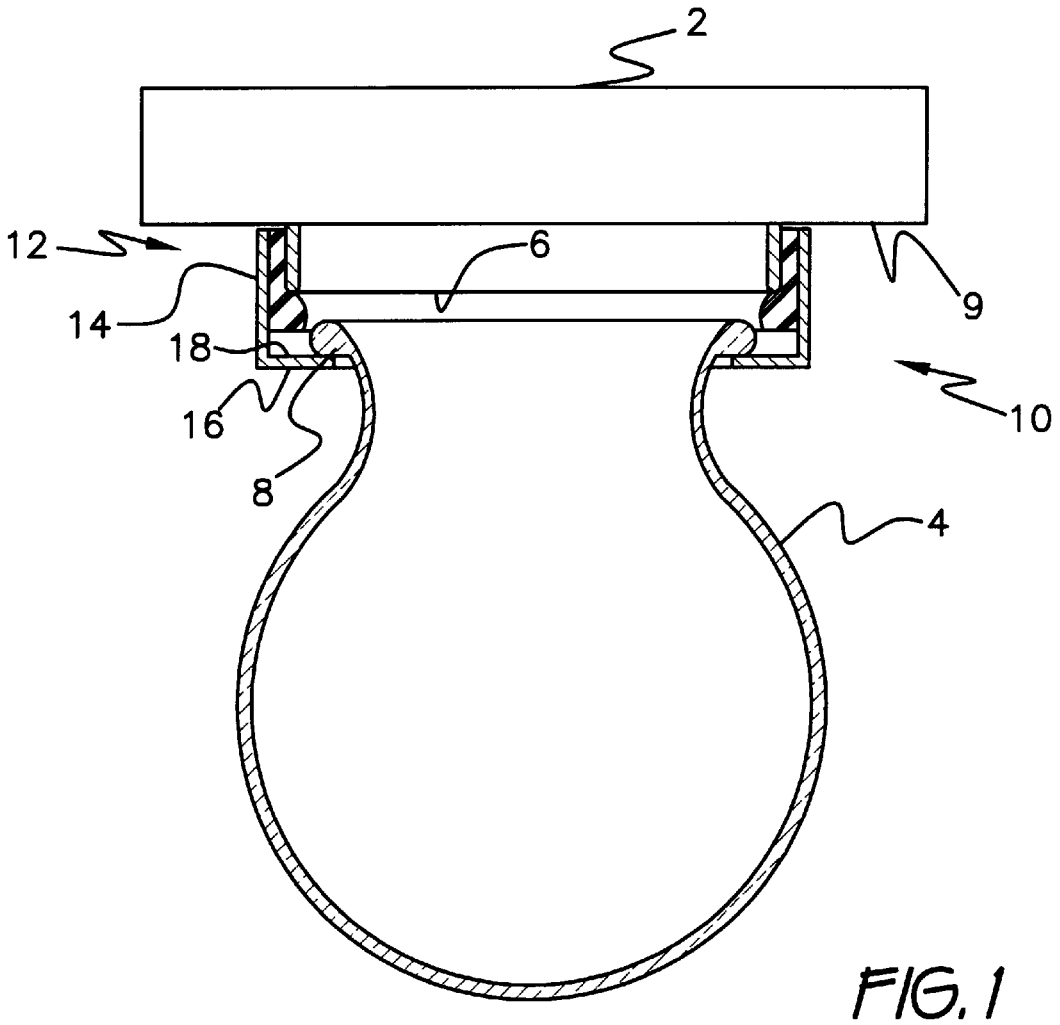
FIG. 1 is an environmental, side elevational, cross sectional view of the invention, showing the invention in the closed condition, installed on the lighting fixture and secured to the globe.

Turning now to FIG. 1 of the drawings, novel attachment ring 10 is shown installed on a lighting fixture 2, securing a globe 4 to lighting fixture 2. Lighting fixture 2 is of the type having a connection tube 6 for engaging globe 4. Conventionally, screws (not shown) are driven through tube 6, in order to pass beneath flange 8 of the neck of globe 4, thereby entrapping globe 4 by interfering fit. Attachment ring 10 engages tube 6, and eliminates these screws.

Attachment ring 10 comprises an encircling member 12 which is L-shaped in cross section, comprising a vertical wall 14 and an inwardly directed ledge 16 providing a contact surface 17. An optional friction enhancing liner 18, which may be formed from a resilient material such as foam rubber or the like, lines the internal surface of vertical wall 14.

Attachment ring 10 is depicted in a closed condition in FIG. 1. This signifies that encircling member 12 is constricted about tube 6 and globe 4 in close proximity, with flange 8 of globe 4 resting on contact surface 17 of ledge 16 of encircling member 12. Ledge 16 provides retaining apparatus for retaining globe 4 by moving an interfering member below flange 8 of globe 8 by radial, inward constriction along a horizontal plane. Liner 18, or in the absence of liner 18, wall 14, provides engagement apparatus for engaging connection tube 6 of lighting fixture 2 by radial, inward constriction. The engagement apparatus contacts connection tube 6 only at the internal, vertical surface of wall 14 or of liner 18.

Figure 2:
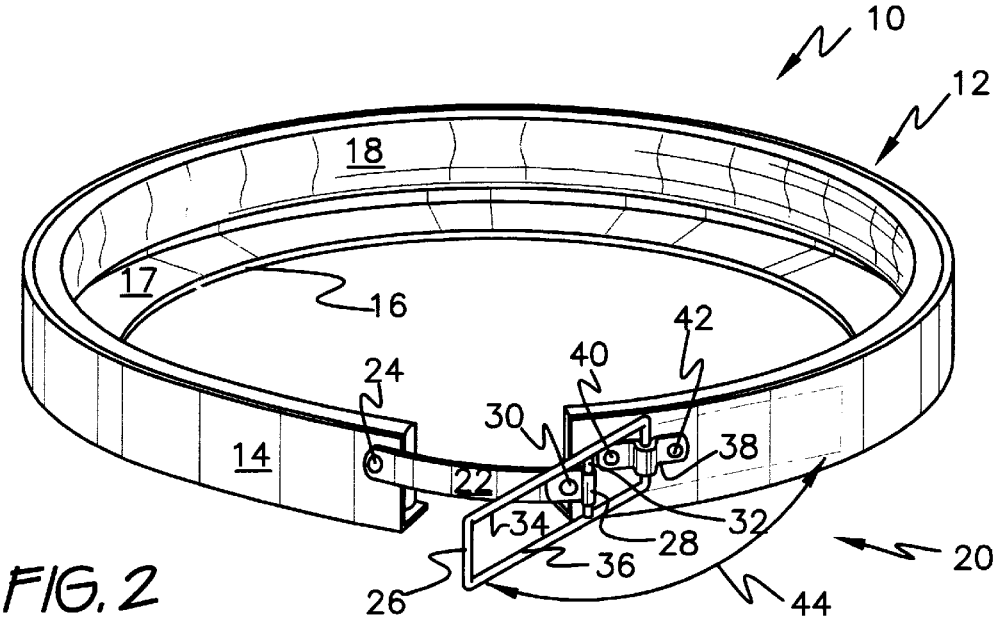
FIG. 2 is a perspective view of the invention.

Attachment ring 10 is shown in an open condition in FIG. 2, isolated from lighting fixture 2 and globe 4. Encirclement member 12 is seen to form a broken or split loop having a C-shaped configuration in the open condition, and a closed, O-shaped configuration in the closed condition of FIG. 1. It will therefore be appreciated that in the closed condition, contact surface 17 is arranged to contact flange 8 almost continuously along three hundred sixty degrees of the circumference of the flanged neck of globe 4. Ledge 16 is configured to have an opening large enough to pass the flanged neck of globe 8.

Since wall 14 and ledge 16 are fixed to one another, they move simultaneously between the open condition shown in FIG. 2, wherein globe 4 and lighting fixture 2 are not engaged by attachment ring 10, and the closed condition of FIG. 1, wherein globe 4 and lighting fixture 2 are engaged by and secured to attachment ring 10.

An actuator 20 not shown in FIG. 1 is clearly visible in FIG. 2. Actuator 20 moves encircling member 12 between the open and closed conditions. Actuator 20 comprises a connecting strap 22 anchored to one end of vertical wall 14 at a rivet 24, and to a handle 26 at an eye 28 formed by folding strap 22 over onto itself and securing with a rivet 30. Eye 28 engages a member 32 of handle 26 spanning upper member 34 and lower member 36 of handle 26.

Handle 26 is anchored to the other end of vertical wall 14 at a suitable pillow block 38 or an equivalent structure pinning handle 26 to vertical wall 14. Pillow block 38 is fastened to vertical wall 14 by rivets 40, 42.

Handle 26 forms a manually operated lever which pivots in pillow block 38 through an arc 44. In the open condition depicted in FIG. 2, handle 26 will be in an open position indicated in solid lines. In the closed condition of FIG. 1, handle 26 is moved to a closed position indicated in broken lines at the right side of arc 44. Strap 22 and handle 26 are configured so that the position of handle 26 in the closed condition is an overcenter position. This feature provides a lock opposing unrestrained swinging of handle 26 back to the open position shown in solid lines, thereby securing the engaging apparatus provided by wall 14 or liner 18 and the retaining apparatus provided by ledge 16 in the closed condition.

Figure 3:
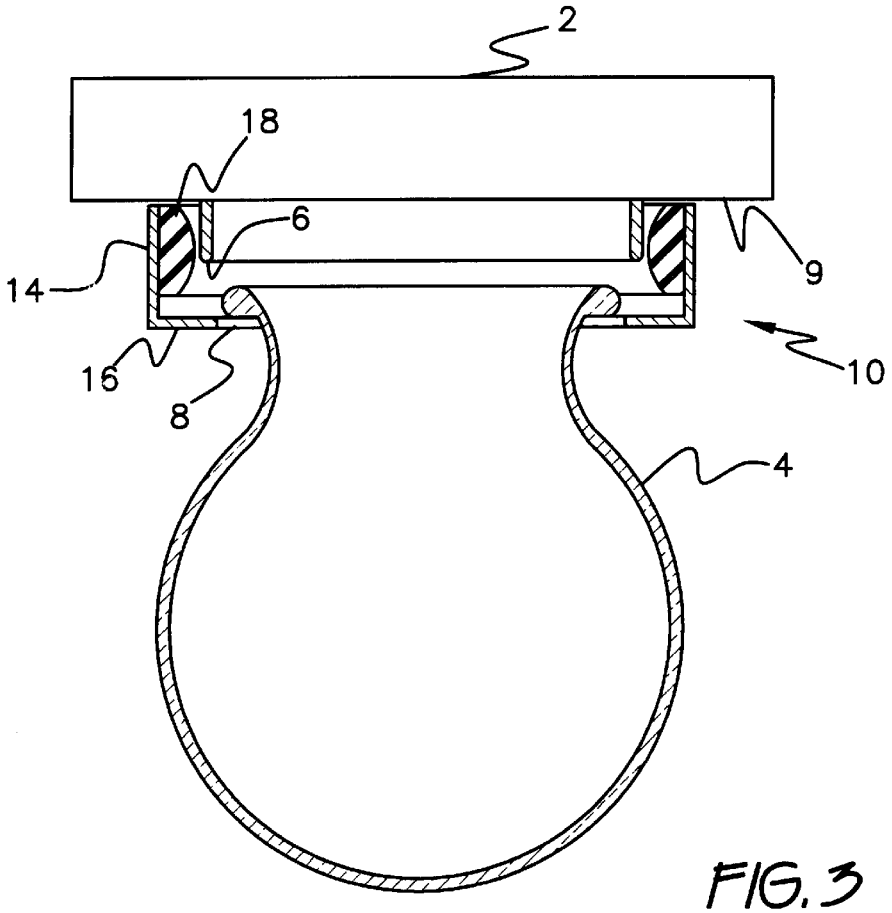
FIG. 3 is an environmental, side elevational, cross sectional view of the invention, showing the invention in the open condition immediately prior to installation.

FIG. 3 illustrates assembly of a globe 4 to a lighting fixture 2. Globe 4 is held by one hand, and positioned directly beneath a lamp (not shown) which is to be enveloped by globe 4. With the other hand, the installer grasps attachment ring 10, locating wall 14 or liner 18 around connection tube 6. Attachment ring 10 may but need not necessarily abut the housing 9 of lighting fixture 2. With globe 4 held high enough to assure that flange 8 will be above ledge 16, handle 26 (omitted from FIG. 3 for clarity) is moved to the closed position. Attachment ring 10 will then close about both connection tube 6 and the flanged neck of globe 4 simultaneously, thereby attaining the relationship among lighting fixture 2, globe 4, and attachment ring 10 depicted in FIG. 1.

The present invention is subject to modifications which may be introduced thereto. For example, actuator 20 could include a cam device rather than the levered mechanism described. Handle 26 could be rearranged to rotate rather than to move through an arc. In a further example, liner 18 could be replaced by a member having inwardly oriented projections which engage screw holes (not shown) formed in connection tube 6. Strap 22 could be replaced by a coil spring (not shown) or other resilient members. Pillow block 38 could be replaced by a tab (not shown) formed from vertical wall 14 and bent into a loop. The invention can be sold as an adapter kit for use with an existing fixture. Many other modifications will occur to those of skill in the art without departing from the inventive spirit.

It is to be understood that the present invention is not limited to the embodiments described above, but encompasses any and all embodiments within the scope of the following claims.

I claim:

1. An attachment ring for securing a globe having a flanged neck to a lighting fixture having a connection tube, comprising an encircling member which is L-shaped in cross section, said encircling member including a vertical wall having an internal, vertical surface, and an inwardly directed ledge having an upwardly facing contact surface, wherein said vertical wall provides engagement apparatus for engaging the connection tube of a lighting fixture only by radial, inward constriction wherein said internal, vertical surface is disposed to contact the lighting fixture only at said internal, vertical surface of said encircling member, and said ledge provides retaining apparatus for retaining the globe by interposing said upwardly facing contact surface below the flange of the globe by radial, inward constriction along a horizontal plane, thereby preventing the globe from falling due to interference between the flange of the globe and said ledge of said encircling member, wherein said engagement apparatus and said retaining apparatus move simultaneously between an open position wherein the globe and the lighting fixture are not engaged, and a closed position wherein the globe and lighting fixture are engaged by and secured to said attachment ring.

2. The attachment ring according to claim 1, further comprising an actuator for moving said encircling member between said open condition and said closed condition, said actuator further comprising a manually operated lever movable to a first position causing said actuator to move said encircling member to said open condition and to a second position causing said actuator to move said encircling member to said closed condition.

3. The attachment ring according to claim 1, wherein said contact surface is arranged to contact the flange of the flanged neck of the globe almost continuously along three hundred sixty degrees of the circumference of the flanged neck of the globe.

4. The attachment ring according to claim 1, said actuator including a lock disposed to secure said engaging apparatus and said retaining apparatus in said closed position.

5. The attachment ring according to claim 1, further comprising a resilient liner disposed on said internal, vertical surface of said vertical wall.

6. A lighting fixture having a manually attachable and removable globe, comprising:

a connection tube depending from said lighting fixture;

a globe having a neck bearing an outwardly projecting flange; and an attachment ring for securing said globe to said connection tube, wherein said attachment ring comprises an encircling member which is L-shaped in cross section, said encircling member including a vertical wall having an internal, vertical surface, and an inwardly directed ledge having an upwardly facing contact surface, wherein said vertical wall provides engagement apparatus for engaging said connection tube of said lighting fixture only by radial, inward constriction wherein said internal, vertical surface is disposed to contact the lighting fixture only at said internal, vertical surface of said encircling member, and said ledge provides retaining apparatus for retaining said globe by interposing said upwardly facing contact surface below said flange of said globe by radial, inward constriction along a horizontal plane, thereby preventing said globe from falling due to interference between said flange of said globe and said ledge of said encircling member, wherein said engagement apparatus and said retaining apparatus move simultaneously between an open position wherein said globe and said connection tube are not engaged, and a closed position wherein said globe and said connection tube are each engaged by and secured to said attachment ring.

7. The lighting fixture according to claim 6, further comprising a resilient liner disposed on said internal, vertical surface of said vertical wall.

* * * * *